United States Patent [19]

Singer

[11] Patent Number: 4,935,709

[45] Date of Patent: Jun. 19, 1990

[54] SWITCHABLE COUPLING APPARATUS FOR TELEVISION RECEIVER ONLY INSTALLATION

[76] Inventor: Samuel Singer, 23 Willowbrook Road, Thornhill, Ontario, Canada, L3T 4V7

[21] Appl. No.: 262,054

[22] Filed: Oct. 24, 1988

Related U.S. Application Data

[63] Continuation of Ser. No. 743,832, Jun. 12, 1985, abandoned.

[51] Int. Cl.[5] ..... H01P 1/10; H01P 5/12

[52] U.S. Cl. ..... 333/101; 333/103; 333/104; 333/109; 333/116

[58] Field of Search ..... 333/101, 103, 104, 105, 333/109, 116, 117

[56] References Cited

U.S. PATENT DOCUMENTS

| | | | |
|---|---|---|---|
| 2,958,054 | 10/1960 | Concelman | 333/105 |
| 3,182,270 | 5/1965 | Horton | 333/105 |
| 3,205,493 | 9/1965 | Cohen | 333/103 X |
| 3,533,019 | 10/1970 | Knirsch | 333/103 |
| 3,551,707 | 12/1970 | Seitzer | 333/103 X |
| 4,492,937 | 1/1985 | Theriault | 333/103 |
| 4,497,030 | 1/1985 | Bowling et al. | 333/101 X |
| 4,507,627 | 3/1985 | Ito et al. | 333/105 |
| 4,527,136 | 7/1985 | Kamiga | 333/103 |
| 4,542,300 | 9/1985 | Nagatomi | 333/103 X |
| 4,584,545 | 4/1986 | Taylor, Jr. et al. | 333/103 |
| 4,595,890 | 6/1986 | Cloutier | 333/103 |
| 4,672,687 | 6/1987 | Horton et al. | 333/103 X |

FOREIGN PATENT DOCUMENTS

| | | | |
|---|---|---|---|
| 2339126 | 2/1975 | Fed. Rep. of Germany | 333/109 |
| 801062 | 9/1958 | United Kingdom | 333/101 |

OTHER PUBLICATIONS

Rutz, E. M.; "Microwave Switching Using Hybrid Junction" *IBM Technical Disclosure Bulletin;* vol. 9, No. 9, Feb. 1967, pp. 1105, 1106.

*Primary Examiner*—Eugene R. LaRoche
*Assistant Examiner*—Benny Lee
*Attorney, Agent, or Firm*—Rogers, Bereskin & Parr

[57] ABSTRACT

A non-radiating broadband microwave coupling device has a housing with first and second signal inputs and outputs, which are connected by respective first and second conductive connection line portions. A third output, also within the housing, is connected to these connection line portions by first and second semiconductor switches, which preferably are connected to parallel coupling line portions to provide inductive coupling. The semiconductor switches are selectively operable to close or switch the respective connection line through to the third output and open the other switch so that there is no significant power transfer to the third output. The connection line portions and the semiconductor switches are shielded within the housing. A corresponding terminator device has a termination resistor, which provides a ground connection for the coupling line portion not connected through to the output. A multiple outlet switch device provides a plurality of output with semiconductor switches controlling the connections to the inputs. One or more of the coupling devices can be combined with the terminator device.

36 Claims, 8 Drawing Sheets

SWITCHABLE COUPLING APPARATUS FOR TELEVISION RECEIVER ONLY INSTALLATION

This is a continuation of application Ser. No. 743,832 filed June 12, 1985, now abandoned.

FIELD OF THE INVENTION

This invention relates to television receiver only (TVRO) installations. More particularly, this invention relates to a multiple television receiver only system (MTVRO), for receiving a signal transmitted from a satellite, and to components for such a system.

BACKGROUND OF THE INVENTION

Recently, there has been tremendous growth in the quantity of television signals transmitted via a satellite. Consequently, there has been a simultaneous growth in the demand for receivers of satellite signals. Such receivers are known as Television Receiver Only (TVRO). Since the transmitting satellite is usually approximately 22,000 miles away, the received signal is quite weak. It is transmitted at a radio frequency around four gigahertz. As a result, relatively sophisticated receiver equipment is required. A typical receiver includes some sort of a dish for collecting the signal, and focussing it on an input horn.

DESCRIPTION OF PRIOR ART

Early receivers had a Low Noise Amplifier at the front end i.e. mounted in the horn, which amplified the received four gigahertz microwave signal. The amplified signal was then transmitted via an appropriate cable to a receiver mounted inside a dwelling. The receiver included radio frequency channel selection, intermediate frequency amplifiers, a video demodulator, an audio modulator and appropriate control circuits. Such an installation is suitable for receiving a signal for distribution over cable TV. The overall performance is good. However, the cost is high. Further, it is difficult and expensive to provide any long runs of radio frequency cable.

More recent designs, typically intended for use by a single consumer, also include a Low Noise amplifier at the front end. From the amplified microwave signal, a desired channel is selected, and this channel is down converted to 17 megahertz. The signal for that channel can then be transmitted relatively easily over an intermediate frequency cable to the receiver located indoors. The receiver then only needs to include an intermediate frequency amplifier, video and audio demodulators, and appropriate control circuits. This has the advantage of producing a relatively low-cost system, which can be installed economically as well. This is achieved by providing the relatively complex radio frequency tuning and conversion components outside on the dish. Then, the receiver itself can be relatively simple.

However, such a system has a number of disadvantages. The frequency stability is poor, and this is aggravated by the mounting of temperature-sensitive circuits outside. These circuits cannot readily be protected from environmental impact. Of considerable importance is the fact that direct conversion to a single channel results in only one channel signal being delivered per system. As a result, this 70 megahertz system is the most expensive on a per program basis, at the present time. It prevents its use in multiple receiver installations. Because of the frequency used, this system tends to be susceptible to interference.

Accordingly, a television receiver only system for receiving a television signal from a satellite, should be economical and should provide a good system performance. It is also desirable that it should have a multiple channel capability and should enable additional channels to be readily taken off, as desired.

SUMMARY OF THE INVENTION

The present invention can be employed in a multiple television receiver only system comprising: a Low Noise amplifier; a block down converter for converting a received signal band down to a band at an intermediate frequency; and coupling means, which can be connected to a plurality of receiver units.

Preferably, the block down converter output has a frequency in the range 950–1450 megahertz, as this frequency band has been selected as the Direct Broadcasting System conversion frequency. Consequently it makes both the multiple television receiver only and the Direct Broadcasting System compatible, with minor changes. It should ensure that this frequency band will remain free of interference in the foreseeable future. The selection of this frequency range has other advantages. Selection of a band at a lower frequency could enable low cost UHF TV tuners to be used as front ends of the receiver units. However, the performance of such tuners is quite low. Further, due to the saturation of the UHF band, such a system is prone to interference. It is anticipated that interference problems will become more severe as the consequence of the projected growth of cellular radio and mobile communication services, using this frequency band.

Satellite TV transmissions are polarized, in order to get the requisite number of channels into the band that is used. Thus, each transmitted signal is polarized into so-called horizontal and vertical signals i.e. first and second signals which are orthogonal to one another, which need to be separated.

In a simple form of the present invention, as described in greater detail below, a polarizer can be provided at the horn, to select the horizontal or vertical signal, which is then amplified by the low noise amplifier. However, for more sophisticated systems, it is preferred to use a dual, polarized feed. The respective horizontal and vertical feeds are then amplified in separate Low Noise amplifiers. The amplified signals are then converted down in separate block down converters.

It is then necessary to provide suitable coupling units, for coupling the intermediate frequency horizontal and vertical signals to separate receivers.

In accordance with one aspect of the present invention, there is provided a non-radiating broadband microwave coupling device comprising: a housing; a first signal input; a second signal input; respective first and second signal outputs; a third output for a microwave signal, with the inputs and outputs mounted in the housing; a first conductive connection line portion connected between the first input and first output; a second conductive connection line portion connected between the second input and the second output, the first and second connection line portions forming a respective connection for signals within a predetermined band; and first and second semi-conductor switch means connected between the output and the first and second connection line portions respectively, and including respective first and second DC control lines and selectably operable, in response to appropriate signals on the first and second control lines and to open a switch means connection between the output and one of the first and second connection line portions to render that line portion disconnected whereby no significant power is transferred to that connection line portion, and simultaneously to close a switch means connection between the third output and the other of the first and second conductive connection line portions, to form a connection for signals within said predetermined band; wherein the first and second connection line portions and first and second semi-conductor switch means are enclosed and shielded within the housing. Preferably, a coupling line, of a quarter wavelength in known manner, runs parallel to each of the vertical and horizontal signal lines. The ends of the coupling lines should be connected via resistances to ground, and the other ends of the coupling lines can be selectively connected via PIN diodes to the third output.

Such a coupling device enables a signal to be taken off from the vertical or horizontal signal line, while transmitting both the vertical and horizontal signals to a further receiver. However, for the last receiver unit in a series of receiver units, the signal lines must be properly terminated, if one is not to get unwanted reflection of the signal.

In accordance with another aspect of the present invention, there is provided a non-radiating broadband microwave terminator device comprising: a housing; a first signal input; a second signal input; an output for a microwave signal and for receiving a constant DC signal, with the inputs and the output mounted in the housing; a termination resistor means connected to ground; a connection semi-conductor switch means, for signals within a predetermined band including first and second connection diodes having positive and negative terminals, connected to the output and to the first and second inputs respectively; a termination semi-conductor switch means, for signals within said predetermined band, including first and second termination diodes connected to the first and second inputs respectively and having positive and negative terminals, with one of the positive terminals and the negative terminals of all of the first and second connection and termination diodes being connected to the first and second inputs respectively, and with the other of those positive and negative terminals of the connection diodes being connected to the output and the other of those positive and negative terminals of the termination diodes being connected to the termination resistor means; and DC control input means which is substantially identical for the first and second inputs includes respective first and second control lines, is connected to the other terminals of the termination and connection diodes, and in response to appropriate signals on the control lines and to a constant DC signal at the output, is capable of simultaneously rendering the connection diode for one input conducting and the termination diode for the other input conducting, whereby said one input is connected through to the output and the other input is grounded through the termination resistor means, wherein the termination resistor means, the DC control input means and the first and second switch means are enclosed and shielded by the housing.

By using vertical and horizontal coupling devices as described above and vertical and horizontal terminator devices, one can arrange for a number of receivers to be supplied with a signal from a single dish. For larger systems, signal splitters and amplifiers can be employed as required.

BRIEF DESCRIPTION OF THE DRAWINGS

For a better understanding of the present invention and to show more clearly how it may be carried into effect, reference will now be made, by way of example, to the accompanying drawings, which show preferred embodiments of the present invention, and in which.

DESCRIPTION OF THE PREFERRED EMBODIMENTS

Figure 1:
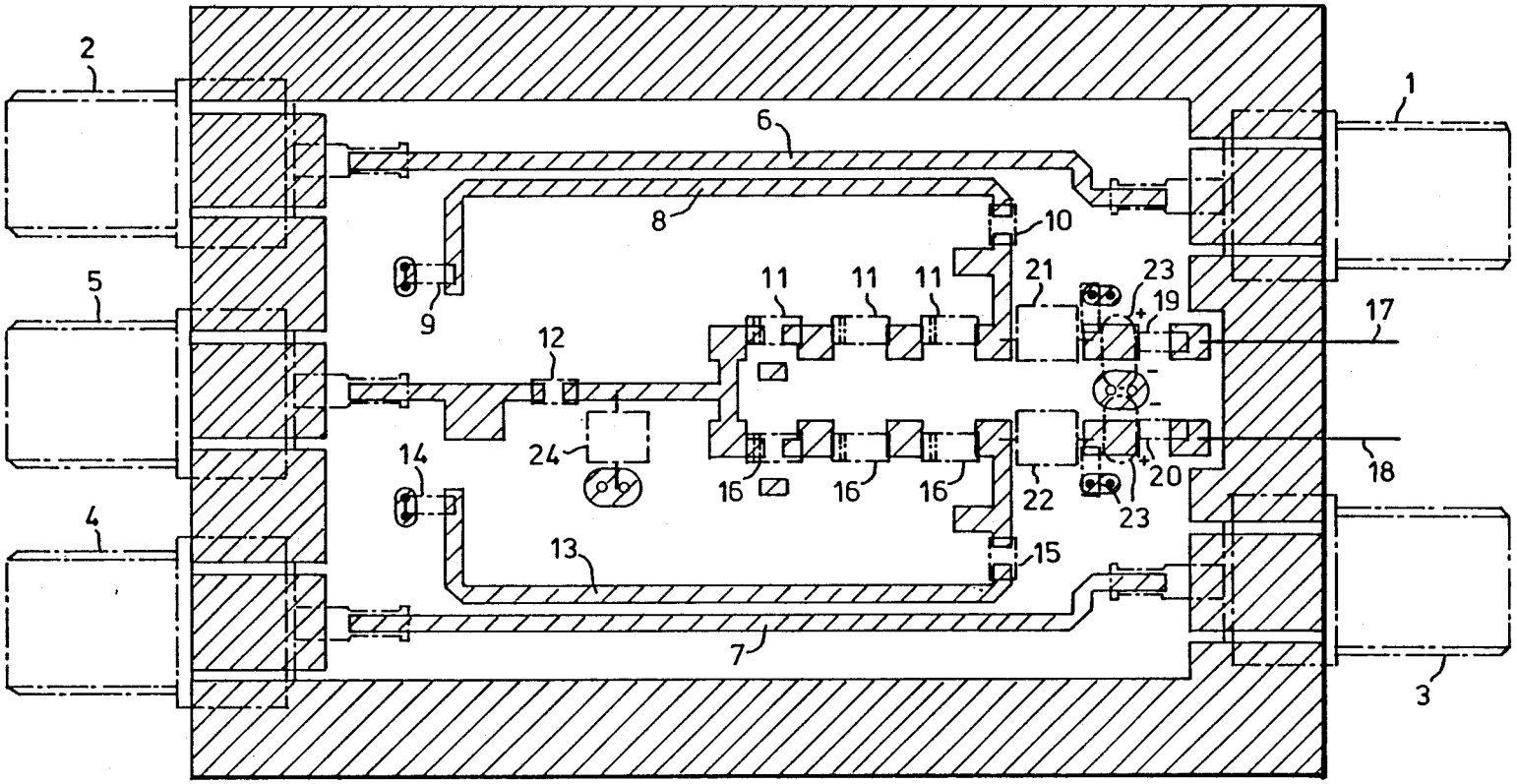
FIG. 1 shows a circuit diagram of a vertical and horizontal coupling device.

Referring to FIG. 1, there is shown a coupling device, which has a horizontal signal input 1 and a horizontal signal input 2. A corresponding vertical signal input 3 and a vertical signal output 4 are provided. A third output 5 is connectable to a receiver.

Running between the horizontal input and output 1, 2 is a horizontal or first, connection signal line portion 6. A corresponding vertical or second, connection signal line portion 7 runs between the vertical input and output 3, 4.

All the lines are formed on a substrate, with the reverse of the substrate being a grounded sheet. In this diagram, small apertures represent holes plated through, to provide a connection from the top surface shown, to the grounded bottom surface.

A horizontal or first, coupling line portion 8 is connected at one end to an appropriate termination resistance 9. The other end of the line 8 is connected via a capacitor 10 to three PIN diodes 11, connected in series. Three PIN diodes 11 are used, in order to get the correct capacitance, although a single PIN diode of appropriate characteristics can be used. The PIN diodes 11 connect the line 8 to third output 5, via a further DC isolating capacitor 12.

For the vertical or second, signals, a corresponding vertical signal coupling line 13 and a termination resistance 14 are provided. The line 13 is connected by a corresponding capicator 15 and series connected PIN diodes 16 to the capacitor 12.

To actuate the PIN diodes 11, 16, two control signal lines 17, 18 are provided. The lines 17, 18 are connected via respective resistances 19, 20 and respective inductors 21, 22, to the PIN diodes 11, 16. Capacitors 23 are further provided. This serves to isolate the rf signal from the DC signal lines 17, 18. When an appropriate signal is sent on one of the control signal lines 17, 18, the corresponding PIN diodes 11 or 16 are switched on. The DC current flows through the diodes, and out through an inductor 24 to ground. The arrangement of the various capacitors and inductors serves to ensure proper isolation of the DC and rf signals.

Thus, in use, a horizontal signal can be supplied along the horizontal signal line portion, and a corresponding vertical signal along the vertical signal line portion 7. With the output 5 connected to a receiver, either one of the horizontal or vertical signals can be connected to the output. It is simply a matter of switching on the appropriate PIN diodes 11, 16. The arrangement of the coupling line portions 8, 13 is such as to provide directional coupling. Further, a relatively small amount of power is taken from the signal travelling on the corresponding signal line portion 6, 7, so that the signals leaving the outlets 2, 4 are of sufficient strength.

As detailed below, this enables a number of receivers to be connected to one satellite dish.

Figure 2:
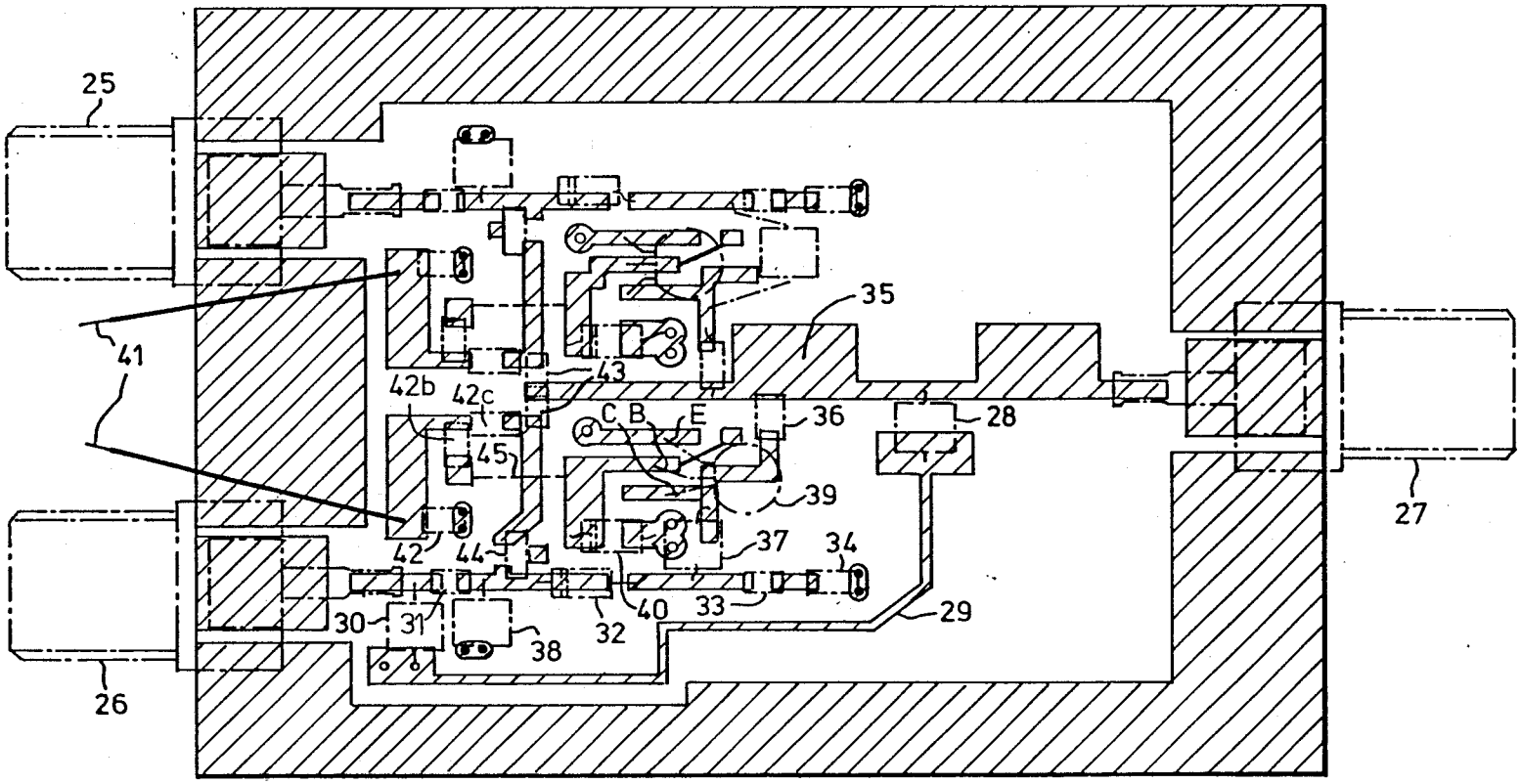
FIG. 2 shows a circuit diagram of a vertical and horizontal terminator device.

With reference to FIG. 2, there is shown a vertical and horizontal terminator device. The terminator device has inputs 25, 26 for the horizontal and vertical signals. It also has an output 27.

A DC supply is delivered from the receiver to the output 27. The output 27 is connected to a line portion inside, which in turn is connected via an inductor 28, a bypass line 29 and a further inductor 30, to the vertical input 26.

Again, all the components are plated onto a substrate, with the reverse of the substrate being a grounded sheet. Small apertures represent holes plated through to the ground sheet. For simplicity, a description will be given of the switching components for the vertical input 26, it being understood that the arrangement for the horizontal input 25 is identical.

The input 26 is connected by a capacitor 31, a PIN diode 32, a further capacitor 33 and a balance termination resistor 34 to ground. Further, a central line 35 is connected via a resistance 36 and an inductor 37 to the PIN diode 32. The other side of the PIN diode is connected via by an inductor 38 to ground.

A switching transistor 39 has its emitter E, base B and collector C connected as shown. Also, a further PIN diode 40 is connected to the base of the transistor 39.

A control line 41 is connected via a network of resistors 42, to a capacitor 43, connected to the central line portion 35.

A further PIN diode 44 is provided connecting the capacitor 43 via the capacitor 31 to the input 26. A jumper lead 45 connects the signal line 41 via one of the resistors 42*b* to the base of the transistor 39. The other resistor 42*c* is connected to the capacitor 43 and diode 44.

The overall arrangement of all of these components is to enable the input 26 to be selectively connected to the output 27 or via the balanced resistor 34 to ground. This depends upon the control signal present on the line 41. In the presence of the correct signal, the PIN diode 32 is switched on, and the PIN diode 44 is non-conducting. When the signal on the line 41 is altered, the PIN diode 32 is non-conducting, and the PIN diode 44 is switched on. The signal from the input 26 is then conducted via the PIN diode 44, capacitor 43 and line portion 35 to the output 27.

The control circuitry for the two inputs 25, 26 is controlled, so that when one input 25, 26 is connected to the output 27, the other input is connected to ground.

The voltage at the control input lines 41 controls the switching condition of the diodes 32, 44, and is described for the input 26. With a positive voltage at the control input 41 (see Table 2 below), the connection through resistor 42*b* reverse biases the diode 40, so that the base emitter junction of the transistor 39 is forward biased. This turns the transistor 39 on. Consequently, DC voltage supplied through the output 27 and resistor 36 is grounded through transistor 39. This pulls down the DC voltage at inductor 37, to ensure that the diode 32 is reverse biased. Simultaneously, DC voltage applied through resistor 42*c* forward biases the PIN diode arrangement 44, through the ground connection at inductor 38. Consequently, there is a high frequency connection through capacitors 31, 43 and PIN diode arrangement 44 between the input 26 and output 27. Simultaneously, a negative voltage would be applied for the control input line 41 for the other input 25, to ensure that it was grounded, as detailed below.

When a negative voltage is applied at the control input line 41, for the input 26, then the transistor 39 is not turned on, since its base emitter junction is reverse biased. This enables the DC signal at the output 27 to pass through resistors 36 and inductor 37, to forward bias the diode 32. Simultaneously, the negative DC voltage is transferred through resistor 42*c*, to reverse bias the PIN diode arrangement 44, again relative to the ground connection through the inductor 38. Thus, the PIN diode arrangement 44 is now reverse biased or turned off, whilst the diode 32 is switched on. Consequently, there is a high frequency connection from the input 26 through capacitor 31, diode 32, capacitor 33 and resistor 34.

Figure 3:
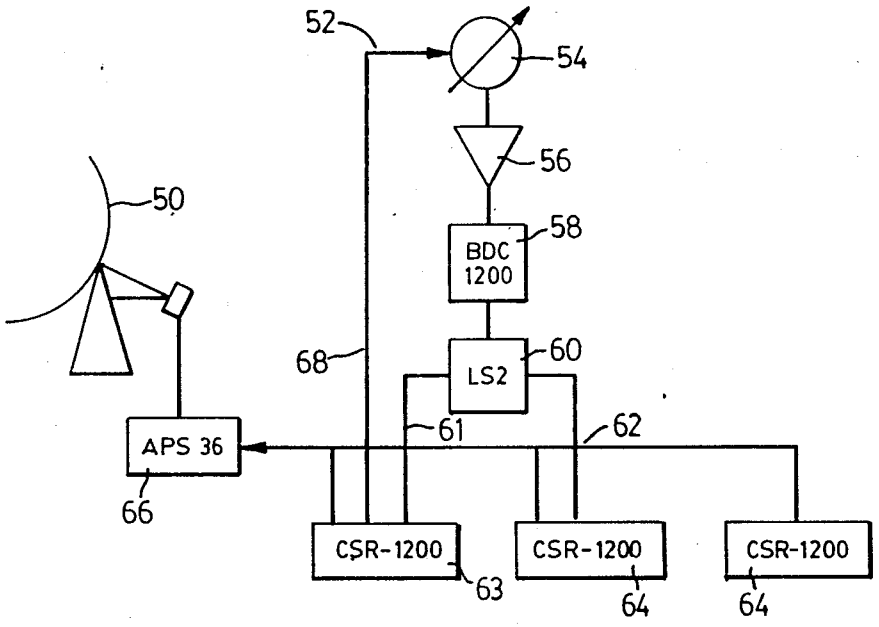
FIG. 3 shows a block diagram of a multiple receiver installation, with a single polarized feed.

Referring now to FIG. 3, there is shown a block diagram of a simple, overall system. Here, a dish antenna is shown schematically and indicated by the reference 50. The horn for the dish antenna 50 is, as is known, located at its focus. An output of the horn antenna is fed to the circuitry at 52. A polarizer 54 receives the horn output. The output of the polarizer is in turn fed to a Low Noise amplifier 56. The amplified signal is then converted down from the four gigahertz frequency to a frequency in the band 950–1450, in a block down converter 58. The output of the block down converter 58 is fed to a power splitting device 60. Here, the amplified signal, now at intermediate frequencies is split into two components and fed to lines 61, 62. The two lines 61, 62 are connected to respective receiver units 63, 64. The receiver units 63, 64 have outputs connected to an antenna control unit 66. This is provided with an appropriate power supply. The antenna control unit 66 controls the position of the dish antenna, and directs it a chosen satellite.

In this simple system, only one of the vertical and horizontal signals received from the satellite is amplified. The first receiver unit 63 has a line 68 connected to the polarizer 54, to select either the vertical or horizontal signals. No such control is provided for each second receiver 64. Thus, in this simple arrangement, the channel selection available to the second receivers 64, depends upon the polarization selected by the first receiver 63. Also, where only one of the vertical and horizontal signals is amplified, then a simple power splitter 60 suffices, for providing the amplified signal.

Figure 4:
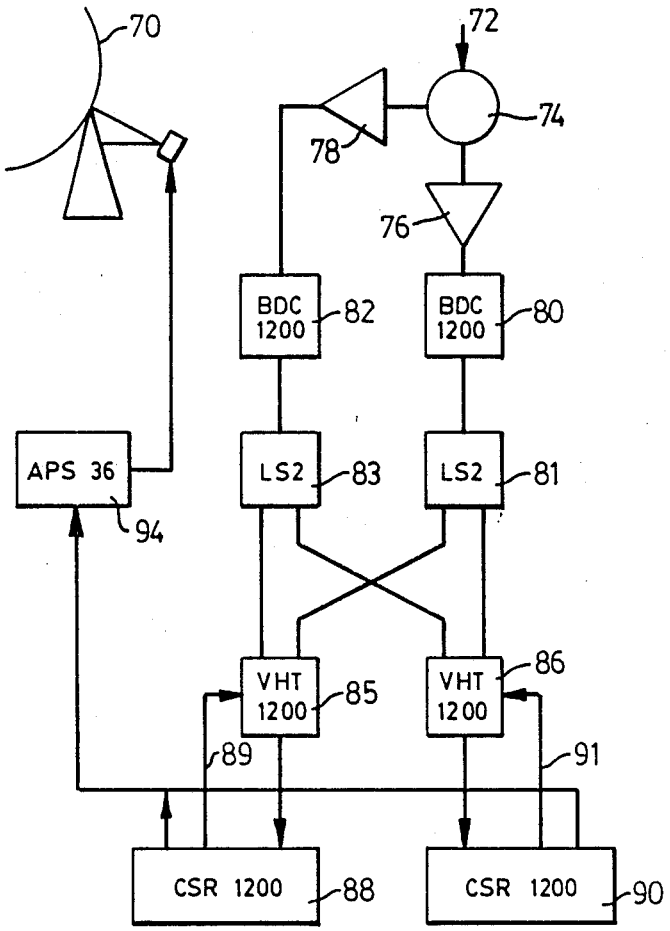
FIG. 4 shows a two-receiver installation, with dual polarized feed.

Reference will now be made to FIG. 4 which shows a second embodiment of the invention. Here, a dish antenna is denoted by the reference 70. Again, it has a horn. The signal from the horn is fed into the circuit at 72. The input feed is polarized or divided into the separate horizontal and vertical signals at 74, and fed to respective separate vertical and horizontal Low Noise amplifiers 76, 78. The vertical Low Noise amplifier 76 is connected to a block down converter 80, and then to a respective power divider 81. Correspondingly, the horizontal Low Noise amplifier 78 is connected to a block down converter 82, which in turn is connected to a power divider 83.

The power dividers 81, 83 divide each of the vertical and horizontal signals. Two vertical and horizontal terminator devices 85, 86 are provided, which are as described above. Each of these vertical and horizontal terminator devices 85, 86 has respective horizontal and vertical signal inputs, which are connected to outputs of the power dividers 81, 83. The output of the first terminator device 85 is connected to a first receiver unit 88, while the output of the second terminator device 86 is connected to a second receiver unit 90.

As indicated by the lines 89, 91, the first and second receivers 88, 90 control the selection of the vertical and horizontal signal in their respective terminator devices 85, 86.

The two receiver units 88, 90 have outputs connected to an antenna control unit 94, for controlling the position of the antenna.

Thus, in this second embodiment, the first and second receiver units 88, 90 can select any channel from both the vertical and horizontal signals, independently of one another. Also, both receiver units 88, 90 can control the position of the antenna 70.

Figure 5:
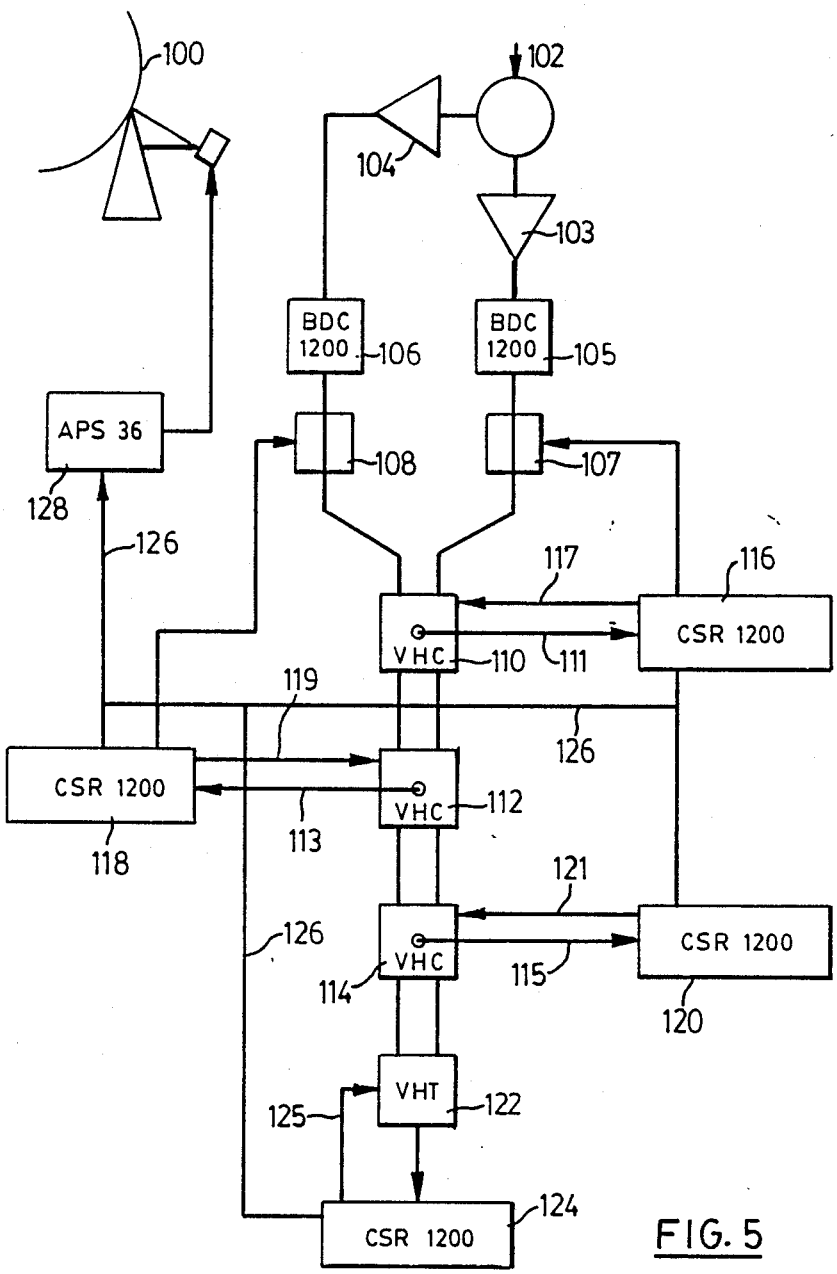
FIG. 5 shows a block diagram of a multiple receiver installation, with dual polarized feed.

Reference will now be made to FIG. 5, which shows a further embodiment of the present invention. In this embodiment, the dish antenna is denoted by the reference 100. Again, a horn input is shown separate from the antenna and indicated at 102. The input is split into horizontal and vertical signals, delivered to respective Low Noise amplifiers 103, 104. As in the previous embodiment, respective block down converters 105, 106 are provided for the vertical and horizontal signals. As before, they convert the four gigahertz signal to an intermediate frequency signal in the range 950–1450 megahertz. Also as before, only the components 102–106 need be located outside.

In earlier embodiments, DC power supply for the Low Noise amplifiers can be provided along the signal line from the Low Noise amplifier, as it does not interfere with the radio frequency. In this case, due to the complexity of the circuit, the DC power supply is inserted into each of the signal lines running from the block down converters 105, 106. The DC inserter units are denoted by the references 107, 108. The DC supply is fed through an inductor, to isolate the alternating component. Further, the alternating component is fed out via a capacitor to isolate the DC component from the later components in the circuit.

In this embodiment, to provide for a number of receivers, the intermediate frequency signals for the vertical and horizontal signals are fed to a first vertical and horizontal coupling device 110. This first coupling device 110 is in turn connected to two further vertical and horizontal coupling devices 112, 114. These coupling devices 110, 112, 114 are as described above, and each includes vertical and horizontal signal lines running through it.

The third output of the first coupling device 110 is connected by a line 111 to a first receiver unit 116. This receiver unit 116 is connected to a polarization control line 117, for controlling the selected polarization from the first vertical and horizontal coupling device 110.

The two other coupling devices 112, 114 are similarly connected. Thus, an output line 113 and a polarization control line 119 connects the second coupling device 112 with a second receiver unit 118. A signal line 115 and a polarization control line 121 connect the third 114 to a third receiver unit 120.

It will thus be seen that here there are continuous vertical and horizontal signal lines running through the coupling devices 110, 112, 114. To ensure proper termination of these signal lines, without unwanted reflection, etc. a vertical and horizontal terminator device is connected to the horizontal and vertical signal lines running from the third coupling device 114. The output of the terminator device 122 is connected to a respective receiver 124, which in turn is connected to a polarization control line 125.

As indicated by line 126, all the receiver units 116, 118, 120, 124 are connected to an antenna control unit 128, for controlling the position of the dish antenna 100. Further, the receiver units have appropriate DC supplies and DC supplies are taken from the receiver units 116, 118 and connected to the DC inserter devices 107, 108.

It will thus be seen that in this embodiment of the invention, there are four separate receiver units, 116, 118, 120 and 124. Each receiver unit is supplied with both the vertical and horizontal signals, and can independently select any channel from these signals. Thus, each receiver can select any channel from a chosen satellite. Further, all the receiver units are provided with control for controlling the position of the dish antenna 100.

This arrangement of FIG. 5 would be suitable for providing signals to a number of television receivers in one household or building. In other words, it can provide signals to a number of television receivers relatively close together.

In many instances, it is anticipated that one will wish to supply signals to separate television receivers, operated by different users, at relatively large spacings. Accordingly, FIG. 6 provides a system suitable for such an application.

Figure 6:
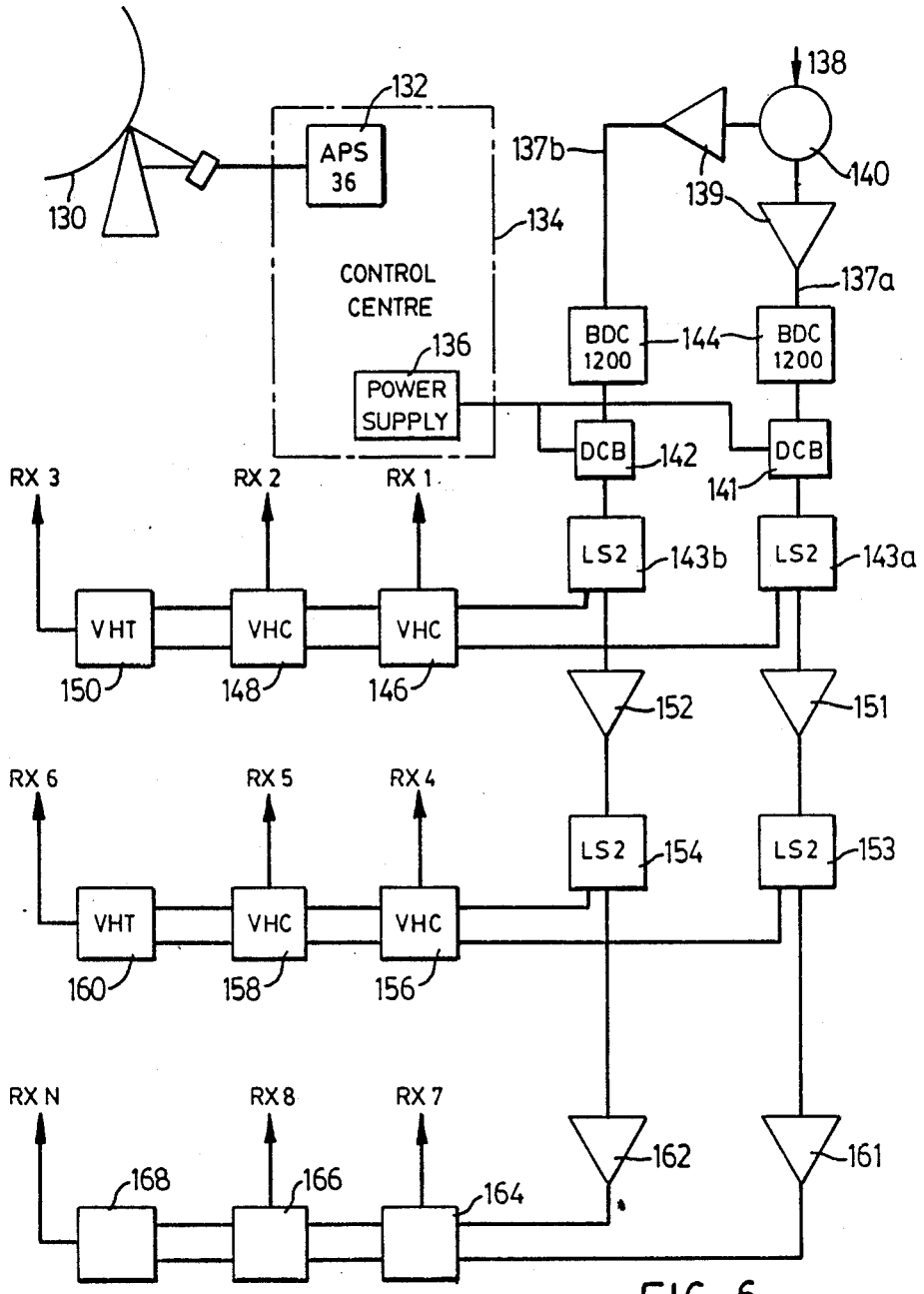
FIG. 6 shows a multiple receiver installation, for multiple users, with dual polarized feed; and, FIGS. 7*a* and 7*b* show a circuit diagram of a multiple tap switch device.

In FIG. 6 the dish antenna is denoted by the reference 130. The dish antenna 130 is connected to an antenna control unit 132 in a control centre 134. Also in the control centre 134 is a power supply 136, which provides a DC power source.

The feed from the horn of the antenna is indicated at 138, and again is polarized at 140 in two separate vertical and horizontal signals. These signals are fed into separate vertical and horizontal signal lines **137*a*, 137*b*. As before, there are separate Low Noise amplifiers 139 and separate block down converters 144. As for the previous embodiment, the DC supply from the power supply 136 is fed into the two signal lines 137*a*, 137*b*, via respective DC insertion devices 141, 142**.

The outputs of the DC insertion devices 141, 142 are fed to respective splitter devices **143*a*, 143*b*. These splitter devices 143*a*, 143*b* simply half the signal, i.e. they are three db splitters. In this case, both of the outputs of each splitter 143*a*, 143*b*** can be isolated by a capacitor, although for other applications a continuous connection can be required for a DC supply.

First outputs of the splitter devices **143*a*, 143*b* are connected to a first vertical and horizontal coupling device 146. The outputs of this first coupling device 146 are in turn connected to a second coupling device 148. Both of the vertical and horizontal coupling devices 146, 148 are as described above. As for the previous embodiment, the output of the second vertical and horizontal coupling device 148 is connected to a vertical and horizontal terminator device 150**.

Each of the devices 146, 148 and 150 is connected via a signal supply line and a polarization control line to a respective receiver unit. These receiver units not being shown for simplicity.

All of these receiver units and the devices 146, 148, 150 would be at one location, i.e. they could be television receiver units in one household, for operation or control by one user.

Now, other television receivers, in another household, could be some distance away. To accommodate this, second outputs of the splitter devices 143*a*, 143*b* are connected to line amplifiers 151, 152. Typically, the households could be 100 feet away, and in this case line amplifiers would be required otherwise the intermediate frequency signals would be excessively attenuated by the time they reach the second household.

In the second household, there are a second pair of splitter devices 153, 154, for the vertical and horizontal signal lines 137*a*, 137*b*.

First outputs of these splitter devices 153, 154 are connected to a third vertical and horizontal coupling device 156. A further vertical and horizontal coupling device 158 and a terminator device 160 are provided in this one household. Again, these devices 156, 158 and 160 are connected to respective fourth, fifth and sixth receiver units. For simplicity these are connected, as their connecting lines.

Other outputs of the splitter devices 153, 154 are connected to a further household. On the assumption that this third household is also a significant distance away, two further line amplifiers 161, 162 are provided in the vertical and horizontal signal lines 137*a*, 137*b*. The outputs of these amplifiers 161, 162 are connected directly to a fifth vertical and horizontal coupling device 164. The outputs of the fifth coupling device 164 are connected to a sixth coupling device 166, which in turn are connected to another vertical and horizontal terminator device 168. These devices 164, 166, 168 are connected to respective seventh, eighth and ninth receiver units. The individual connections to these receiver units and the receiver units are again omitted for clarity.

Thus, in this arrangement, in each househould there can be a number of separate receiver units. While three receiver units are indicated for each household, the number can be varied as desired. Each receiver unit is supplied with both the vertical and horizontal signals, so that any channel can be selected. Here, each receiver unit only has a polarization control. Control of the antenna and DC power would be from the control centre 134. The provision of the line amplifiers 151, 152, 161, 162 enables the households to be a considerable distance apart. While connections to three separate households or users have been indicated, it is to be appreciated that by simply providing additional splitters, a large number of separate users could be supplied with a signal.

Figure 7A:
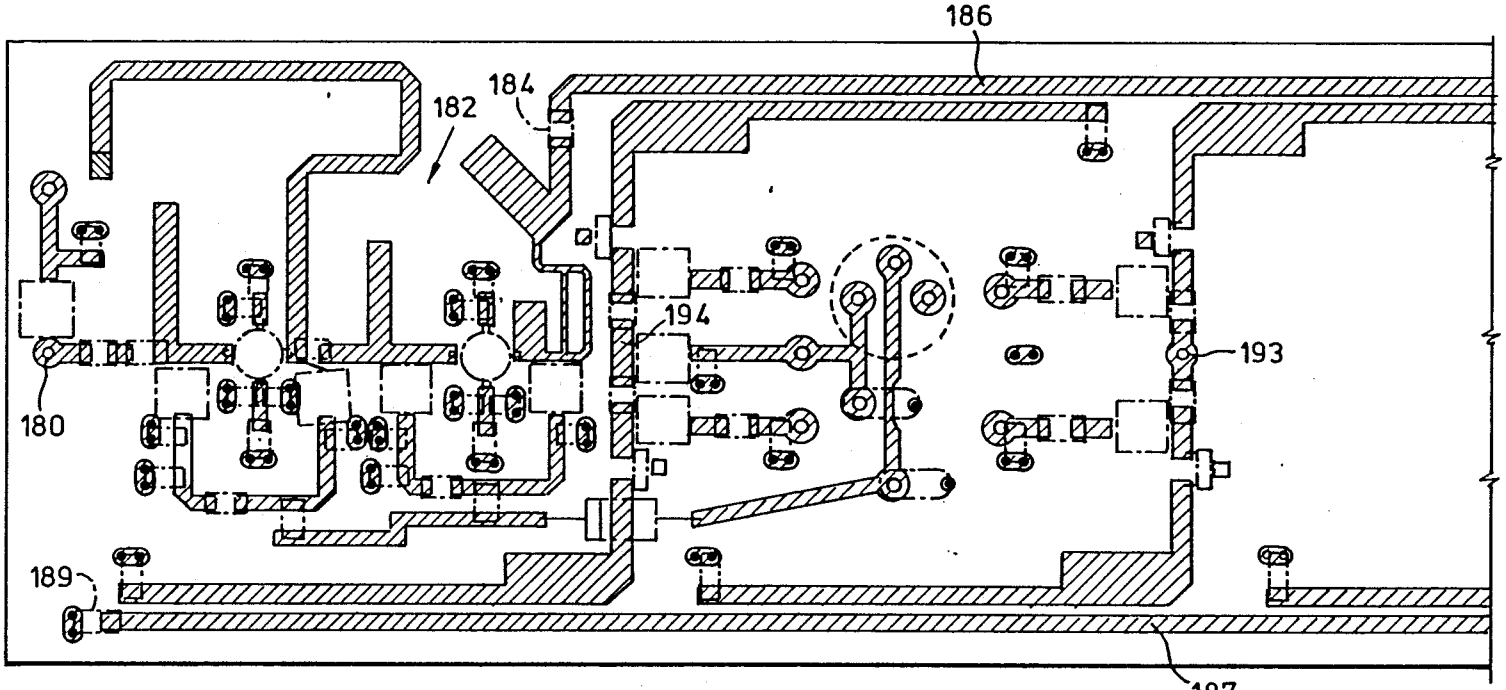
Figure 7B:
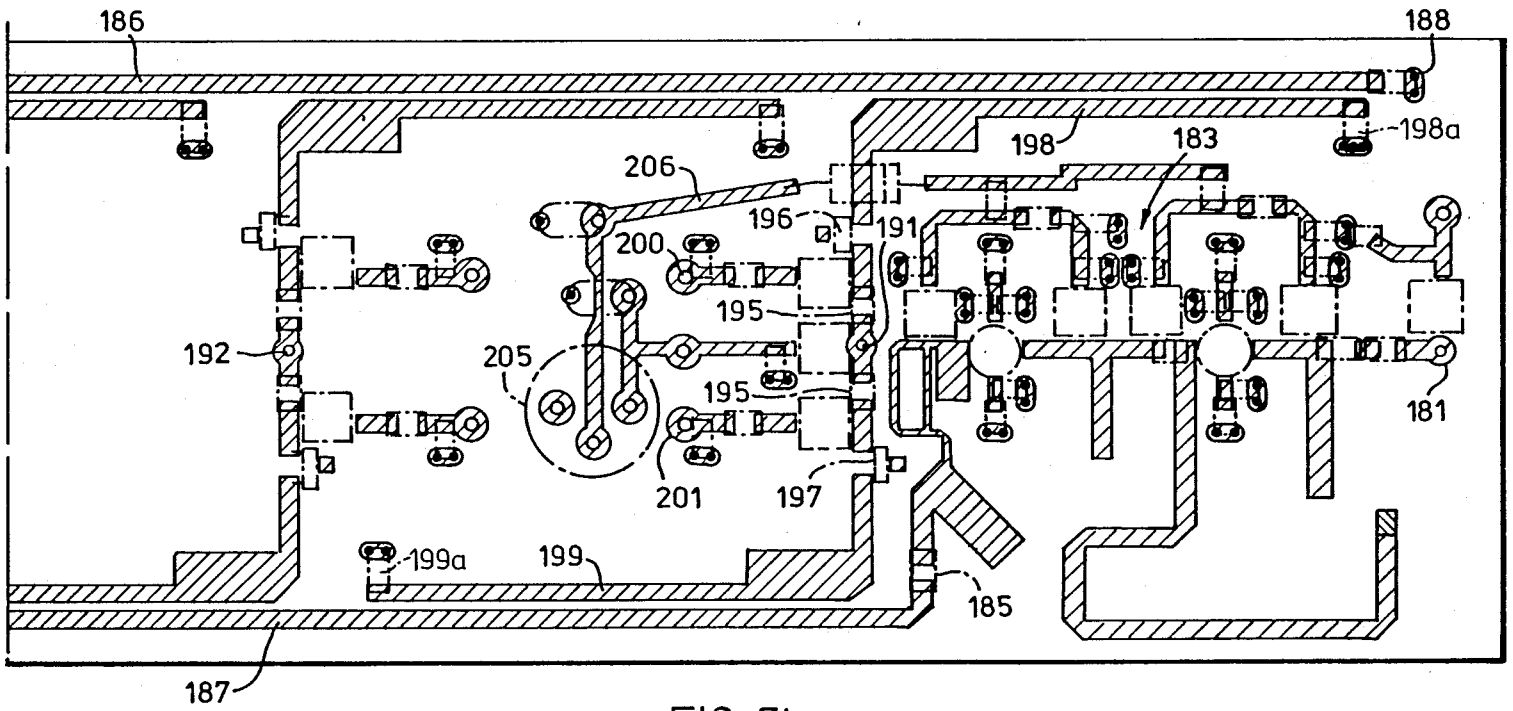

Reference will now be made to FIGS. 7*a*, 7*b*, which show a multiple tap switch device. In general terms, this can be considered to be a number of the coupling devices and terminator devices described above in relation to FIGS. 1 and 2, together with a pair of amplifiers.

An input 180 is provided for a horzontal signal, and a further input 181 is provided for a vertical signal. For the horizontal and vertical signals respective amplifier circuits 182, 183 are provided. Each amplifier circuit 182, 183 includes two transistors.

The amplified horizontal signal is delivered via a capacitor 184 to a respective horizontal signal line portion 186 running along the length of the substrate (as before all the lines are on one side of the substrate, and some lines are plated through to the ground sheet below). The amplified vertical signal is correspondingly connected via a capacitor 185 to a vertical signal line portion 187. The two signal line portions 186, 187 are connected via appropriate resistances 188, 189 to ground, to ensure that the signals are always properly terminated.

In this switch, provision is made for connection to four separate receivers. For this purpose, four separate outlet connections 191, 192, 193, 194 are provided. Similar control arrangements are provided for each of the outlets 191, 194. These control arrangements are similar to those described above for the connection switch of FIG. 1. For simplicity, the control arrangement is described in relation to the outlet connection 191 only, the control arrangement for the other outlets corresponding.

The outlet 191 is connected via capacitors 195 and respective PIN diodes 196, 197 to corresponding horizontal and vertical coupling line portions 198, 199. The horizontal coupling line portion 198 ends in an appropriate termination resistor, 198*a* and is disposed parallel to the horizontal signal line 186, so as to be directionally coupled to it. The vertical coupling line portion 199 is similarly arranged and ends in appropriate termination resistor 199*a*.

To control the connection of the coupling line portions 198, 199 to the outlet 191, two control signal inputs 200, 201 are provided. The input 200 is connected via a resistor and inductor in series to a junction between a respective capacitor 195 and the PIN diode 196. The other input 201 is correspondingly connected via a resistor and inductor to a junction between the respective capacitor 195 and the PIN diode 197.

By providing appropriate DC voltage levels at the inputs 200, 201, one of the coupling line portions 198, 199 can be connected to the outlet 191. Thus, with the PIN diode 196 conducting, and the PIN diode 197 open circuit, the horizontal coupling line portion 198 will be connected to the outlet 191.

Power for the amplifiers for amplifiers 182, 183 is provided from the receivers through the outlets 191, 194. Again, a description will be given of the power supply from the inlet 191, to the amplifier 183 only.

The DC supply through the outlet 191 can only pass through an inductor, it being isolated by the capacitors 195, to a voltage regulator 205. As the DC level supplied can vary greatly, typically between 18–25 volts, the voltage regulator 205 controls the DC voltage to the required 12 volts. This is then supplied via a line 206 to the amplifier 183.

It will thus be seen that the multiple switch device effectively provides four coupling switches for four outlets to enable each of four receivers to pick up any channel as desired. It also ensures proper termination of the horizontal and vertical signal lines. The provision of amplifiers ensures that there are no losses in this unit.

By way of example, there follows two tables giving typical operating parameters for the horizontal and vertical coupling device (Table 1), and for the horizontal and vertical terminator (Table 2).

TABLE 1

| Specifications | |
|---|---|
| Operating Frequency | 950–1450 MHz |
| Input Return Loss (Ports 1 & 2) | 14 dB min (VSWR 1.5:1) |
| Output Return Loss (Ports 3 & 4) | 14 dB min (VSWR 1.5:1) |
| Output Return Loss (Port 5) | 14 dB min (VSWR 1.5:1) |
| Through Insertion Loss | |
| (1 to 3) | 1.2 dB max |
| (2 to 4) | |
| Coupled Insertion Loss | |
| (1 to 5) | 11 ± 1 dB |
| (2 to 5) | |
| Directivity | |
| (3 to 5) | 15 dB min |
| (4 to 5) | |
| Switching Voltage | |
| On | +12 to 25 VDC (30 MA max) |
| Off | −30 to 0 VDC |
| Connectors | |
| (RF) | Type 'F' Female (75 Ohm) |
| (DC) | Terminal Block |

TABLE 2

| Specifications | |
|---|---|
| Operating Frequency | 950–1450 MHz |
| Input Return Loss | |
| (on line) | 14 dB min (VSWR 1.5:1) |
| (off line) | 14 dB min (VSWR 1.5:1) |
| Insertion Loss | |
| (on line) | 3.3 dB max |
| (off line) | 25 dB min |
| Isolation | |
| (on channel) | 25 dB min |
| (off channel) | 35 dB min |
| Switching Voltage (A or B) | On +12 to +32 VDC(30 Ma max) |
| | Off −30 to +2 VDC |
| Connectors | |
| (RF) | Type 'F' Female, 75 Ohm. |
| (DC) | Terminal Block |

I claim:

1. In combination, one or more non-radiating broadband microwave coupling devices, each of which comprises: a housing; first and second signal inputs mounted in the housing; first and second signal outputs mounted within the housing; a third output mounted within the housing; a substrate means within the housing, and including a first conductive connection line portion connected between the first input and the first output, a second conductive connection line portion connected between the second input and the second output, first and second conductive coupling line portions arranged parallel to the first and second connection line portions respectively on one side of the substrate means, and a grounded sheet on the other side of the substrate means; and first and second semi-conductor switch means connected between the third output and one ends of the first and second coupling line portions respectively, and said first and second semi-conductor switch means selectively operable to open a switch means connection between the third output and one of the first and second coupling line portions to render that coupling line portion disconnected whereby no significant power transfers to that coupling line portion, and simultaneously to close a switch means connection between the third output and the other of the first and second coupling line portions, the semi-conductor switch means being provided within the housing; and a non-radiating broadband microwave terminator device comprising: a terminator housing; a first signal input; a second signal input; an output with the inputs and output mounted in the terminator housing; a termination resistor means connected to ground; a first semi-conductor switch means, for signals within a predetermined band including first and second connection diodes having positive and negative terminals connected between the output and the first and second inputs respectively; a second semi-conductor switch means, for signals within said predetermined band, including first and second termination diodes having positive and negative terminals and connected between the termination resistor means and the first and second inputs respectively, with one of the positive terminals and the negative terminals of all of the first and second connection and termination diodes being connected to the first and second inputs and the other of those positive and negative terminals of the connection diodes being connected to the output and the other of the positive and negative terminals of the termination diodes being connected to the termination resistor means; and DC control input means which is connected to the other terminals of the termination and connection diodes, and is capable of simultaneously rendering the connection diode for one input conducting, whereby said one input is connected through to the output, and rendering the termination diode for the other input conducting, whereby said other input is grounded through the termination resistor means; wherein the termination resistor means, the DC control input means and the first and second switch means are enclosed and shielded by the terminator housing; and wherein the first inputs and outputs of the microwave coupling and terminator devices are successively connected in series and the second signal inputs and outputs of the microwave coupling and terminator devices are successively connected in series.

2. A combination as claimed in claim 1, wherein, for each coupling device, the device includes first and second control lines connected to the first and second semi-conductor switch means respectively, which switch means are operable in response to control signals on the control lines and wherein, for the terminator device, the output is adapted to receive a constant DC input, which is connected to the DC control input means, and the terminator device includes first and second control signal lines connected to the DC control input means, which is operable in response to control signals on the control signal lines and the DC signal supplied through the output thereof.

3. A combination as claimed in claim 2, wherein, for each coupling device, the first and second semi-conductor switch means are such that, when the respective coupling line portion is disconnected, that coupling line portion is disconnected both from the third output and from any ground connection, so as to be floating.

4. A multiple outlet microwave switch device comprising: a housing; a substrate within the housing; a first input in the housing; a first connection line portion extending along the substrate and connected to the first input; a second input in the housing; a second connection line portion extending along the substrate and connected to the second input; a plurality of outputs in the housing; for each output, a first coupling line portion on the substrate extending parallel and adjacent to the first connection line portion, and a second coupling line portion on the substrate extending parallel and adjacent to the second connection line portion; and semi-conductor switch means connected between the outputs and the coupling line portions for controlling connection therebetween.

5. A multiple outlet device as claimed in claim 4, wherein the first and second connection lines are connected, at their ends remote from the first and second inputs, to ground via termination resistors.

6. A multiple outlet device as claimed in claim 5, wherein each outlet is connected via first and second capacitors to one ends of the first and second coupling line portions, respectively and wherein for each outlet, first and second termination resistors are provided connecting the other ends of the first and second coupling line portions to ground, and the semi-conductor switch means comprises first and second PIN diodes in the first and second coupling line portions and first and second control lines connected to the first and second coupling line portions respectively between the capacitors and the PIN diodes.

7. A non-radiating broadband microwave coupling device comprising: a housing; a first signal input; a second signal input; respective first and second signal outputs; a third output for a microwave signal, with the inputs and outputs mounted in the housing; a first conductive connection line portion connected between the first input and the first output; a second conductive connection line portion connected between the second input and the second output, with the first and second connection line portions forming respective connections for signals within a predetermined band; and first and second semi-conductor switch means connected between the third output and the first and second connection line portions respectively and including first and second DC control lines connected separately to the first and second semi-conductor switch means respectively, said first and second semi-conductor switch means selectably operable, in response to appropriate control signals on the first and second control lines, to open a switch means connection between the third output and one of the first and second connection line portions to render that connection line portion disconnected whereby no significant power is transferred from that connection line portion, and simultaneously to close a switch means connection between the third output and the other of the first and second conductive connection line portions, to form a connection for signals within said predetermined band; wherein the first and second connection line portions and the first and second semi-conductor switch means are enclosed and shielded within the housing.

8. A coupling device as claimed in claim 7, wherein the first and second connection line portions are mounted on a substrate, and which includes first and second conductive coupling line portions, which are mounted parallel to respective first and second connection line portions, whereby inductive coupling is provided between each pair of connection and coupling line portions, the first and second coupling line portions being connected to the first and second semi-conductor switch means respectively.

9. A coupling device as claimed in claim 8, wherein the connection and coupling line portions are mounted on a common substrate, wherein each of the coupling line portions has a length of approximately one quarter of a wave length within the predetermined band, and a termination resistance is provided at one end of each coupling line portion connecting that coupling line portion to ground, the coupling line portion being oriented so that the signals travel along the connection and coupling line portions in the same direction, thereby providing directional coupling.

10. A coupling device as claimed in claim 9, wherein the coupling and connection line portions are provided on one side of the substrate, and a common grounded sheet is provided on the other side of the substrate, with the termination resistances connected through the substrate to the grounded sheet.

11. A coupling device as claimed in claim 8, 9 or 10, wherein the first and second switch means include PIN diodes connected between the first and second coupling line portions, respectively and the third output, within the housing.

12. A coupling device as claimed in claim 10, wherein the first and second semi-conductor switch means include respective first and second PIN diodes connected between the respective first and second coupling line portions and the third output within the housing, and each of the first and second DC control lines is connected to one terminal of the respective first or second PIN diode, and a first, grounding inductance is connected between the other terminal of the PIN diodes and the grounded sheet to provide a DC ground connection.

13. A coupling device as claimed in claim 12, wherein the first and second coupling line portions are connected to the first and second PIN diodes respectively by means of DC isolating capacitors, and wherein each control signal line is connected to the one terminal of a respective PIN diodes by a respective microwave isolating inductance.

14. A coupling device as claimed in claim 13, wherein a DC isolating capacitor is provided between the other terminals of the PIN diodes and the third output, and between the first grounding inductance and the third output.

15. A coupling device as claimed in claim 14, which includes further isolating capacitors connecting the control lines to the grounded sheet, said capacitors being connected to the portions of the control lines within the housing.

16. A coupling device as claimed in claim 13, 14 or 15, wherein for each semi-conductor switch means, each PIN diode comprises a plurality of discrete PIN diodes connected in series.

17. A coupling device as claimed in claim 12, 13 or 15, wherein the inputs and outputs comprise coaxial connectors.

18. A microwave coupling device comprising: a housing; first and second signal inputs mounted in the housing; first and second signal outputs mounted within the housing; a third output mounted within the housing; a substrate means within the housing, and including a first conductive connection line portion connected between the first input and the first output, second conductive connection line portion connected between the second input and the second output, first and second conductive coupling line portions arranged parallel to the first and second connection line portions respectively on one side of the substrate means, and a grounded sheet on the other side of the substrate means; and first and second semi-conductor switch means connected between the third output and one ends of the first and second coupling line portions respectively, and said first and second semi-conductor switch means selectively operable to open a switch means connection between the third output and one of the first and second coupling line portions to render that coupling line portion disconnected from the third output and any ground connection whereby no significant power transfers to that coupling line portion, and simultaneously to close a switch means connection between the third output and the other of the first and second conductive coupling line portions, the semi-conductor switch means being provided within the housing.

19. A coupling device as claimed in claim 18, wherein the first and second connection line portions are located adjacent opposite edges of one side of the substrate, and the other end of each coupling line portion is connected via a termination resistance to the grounded sheet, the coupling line portions being oriented so that signals travel along each pair of coupling and connection line portions in the same direction, to provide directional coupling.

20. A coupling device as claimed in claim 18 or 19, wherein the semi-conductor switch means comprises PIN diodes, and which includes control signal lines extending through the housing to the PIN diodes and inductive and capacitive isolation means providing isolation between DC control signals for the PIN diodes and microwave signals.

21. A non-radiating broadband microwave terminator device comprising: a housing; a first signal input; a second signal input; an output for outputting a microwave signal and for receiving a constant DC signal, with the inputs and the output mounted in the housing; a termination resistor means connected to ground; a connection semi-conductor switch means, for signals within a predetermined band, including first and second connection diodes having positive and negative terminals, connected between the output and the first and second inputs respectively; a termination semi-conductor switch means, for signals within said predetermined band, including first and second termination diodes connected between the termination resistor means and the first and second inputs respectively and having positive and negative terminals, with one of the positive terminals and the negative terminals of all of the first and second connection and termination diodes being connected to the first and second inputs, and with the other of those positive and negative terminals of the connection diodes being connected to the output and the other of those positive and negative terminals of the termination diodes being connected to the termination resistor means; and DC control input means which includes respective first and second control lines, is connected to the other terminals of the termination and connection diodes, and in response to appropriate control signals on the control lines and to a constant DC signal at the output is capable of simultaneously rendering the connection diode for one input conducting and the termination diode for the other input conducting, whereby said one input is connected through to the output and the other input is grounded through the termination resistor means, wherein the termination resistor means, the DC control input means and the first and second switch means are enclosed and shielded by the housing.

22. A terminator device as claimed in claim 21, which includes includes a substrate, one side of which a grounded sheet and other side of which includes respective first and second conductive input line portions connected to the first and second inputs, and a conductive output line portion connected to the output, with the connection diodes connected between the input line portions and the output line portion, the termination diodes connected between the input line portions and the termination resistor means, and the termination resistor means connected through the substrate to the grounded sheet.

23. A terminator device as claimed in claim 22, wherein each of the connection and termination diodes comprises a PIN diode.

24. A terminator device as claimed in claim 22, which includes first and second conductive intermediate line portions on the substrate and first isolating capacitors, the output line portion being connected via the isolating capacitors to the first and second intermediate line portions, which are connected respectively to the other terminals of the first and second connection diodes, and which includes first, grounding inductances connected between the first and second input line portions and the grounded sheet.

25. A terminator device as claimed in claim 24, wherein the DC control input means includes first and second control transistors and wherein the first and second control lines are connected to the other terminals of the first and second connection diodes and to the first and second transistors respectively with the first and second transistors also being connected to the other terminals of the termination diodes.

26. A terminator device as claimed in claim 4, which includes first and second conductive auxiliary line portions, first and second auxiliary inductors connecting the respective first or second auxiliary line portion to the other terminal of the respective first or second termination diode, with each transistor being connected to the respective auxiliary line portion, and wherein the termination resistor means comprises first and second termination resistors, each of which is connected between the grounded sheet and the other terminal of the respective first or second termination diode, the auxiliary line portions providing a path to the termination diodes for a DC signal supplied through the output, and wherein the first and second transistors are connected to the respective first and second auxiliary line portions and to the grounded sheet, for either permitting a DC voltage at the output to be applied to the other terminal of the respective termination resistor or grounding that DC voltage, in response to the voltage at the respective first or second control line.

27. A terminator device as claimed in claim 26, wherein isolating capacitors are provided between each of the first and second termination resistors and the first and second auxiliary inductors, to isolate a DC signal from ground.

28. A terminator device as claimed in claim 27, which includes resistors between the output line portion and the first and second auxiliary line portions.

29. A terminator device as claimed in claim 28, wherein each of the first and second transistors has its collector connected to the respective first or second auxiliary line portion, its emitter connected to the grounded sheet, and its base connected to a respective control line.

30. A terminator device as claimed in claim 29, which includes first and second conductive control line portions on the substrate, to which the first and second control lines are connected, and which further includes grounding resistors connecting the first and second control line portions to the grounded sheets, resistors connecting the control line portions to the respective intermediate line portions and to the respective bases of the first and second transistors, the device further including further diodes connecting the bases of the transistors to the grounded sheet, which diodes are reverse biased when the corresponding transistor base-emitter junction is forward biased.

31. A terminator device as claimed in claim 23, 26 or 30, which includes a by-pass line connected via inductances between the output line portion and one of the first and second input line portions, to provide a DC connection between the output and the respective first or second input.

32. A multiple outlet device as claimed in claim 6, wherein, for each outlet, the first and second control lines include isolating inductances.

33. A multiple outlet device as claimed in claim 32, which includes first and second amplifiers, the first input being connected via the first amplifier to the first connection line portion and the second input being connected via the second amplifier to the second connection line portion.

34. A multiple outlet device as claimed in claim 33, which includes isolating capacitors between the first and second amplifiers and the first and second connection line portions respectively.

35. A multiple outlet device as claimed in claim 6, wherein at least one of the outlets serves as an input for a DC power signal for the amplifiers, and each such outlet includes a connection via an inductor and a voltage stabilizer to the respective amplifier.

36. In combination, one or more non-radiating broadband microwave coupling devices, each of which comprises: a housing; a first signal imput; a second signal input; respective first and second signal outputs; a third output for a microwave signal, with the inputs and outputs mounted in the housing; a first conductive connection line portion connected between the first input and the first output; a second conductive connection line portion connected between the second input and the second output, with the first and second connection line portions forming respective connections for signals with a predetermined band; and first and second semi-conductor switch means connected between the third output and the first and second connection line portions respectively, and said first and second semi-conductor switch means selectably operable to open a switch means connection between the third output and one of the first and second connection line portions to render that connection line portion disconnected whereby no significant power is transferred from that connection line portion, and simultaneously to close a switch means connection between the third output and the other of the first and second conductive connection line portions, to form a connection for signals within said predetermined band; the first and second connection line portions and the first and second semi-conductor switch means being enclosed and shielded within the housing; and a non-radiating broadband microwave terminator device comprising: a terminator housing; a first signal input; a second signal input; an output, with the inputs and output mounted in the terminator housing; a termination resistor means connected to ground; a first semi-conductor switch means, for signals within a predetermined band, connected to the output and selectively connectable to one of the first and second inputs, to form a respective connection for signals within said predetermined band; and a second semi-conductor switch means, for signals within said predetermined band, connected to the termination resistor means and selectably connectable to the other of the first and second inputs; wherein the termination resistor means and the first and second switch means are enclosed and shielded by the terminator housing;

wherein the first signal inputs and outputs of the microwave coupling and terminator devices are successively connected in series, and the second signal inputs and outputs of the microwave coupling and terminator devices are successively connected in series.

* * * * *